United States Patent [19]

English et al.

[11] Patent Number: 4,516,916

[45] Date of Patent: May 14, 1985

[54] OIL COOLED, HERMETIC REFRIGERANT COMPRESSOR

[75] Inventors: William A. English; Robert R. Young, both of Murrysville, Pa.

[73] Assignee: Westinghouse Electric Corp., Pittsburgh, Pa.

[21] Appl. No.: 447,927

[22] Filed: Dec. 9, 1982

[51] Int. Cl.[3] ..... F04B 39/06; F25B 43/02

[52] U.S. Cl. ..... 417/368; 417/372; 417/902; 62/469; 62/505

[58] Field of Search ..... 417/368, 372, 902, 366, 417/369, 370, 371, 312; 62/469, 505; 310/54, 57

[56] References Cited

U.S. PATENT DOCUMENTS

| | | | |
|---|---|---|---|
| 2,178,425 | 10/1939 | Johnson | 417/902 |
| 2,228,364 | 1/1941 | Philipp | 417/372 |
| 2,492,611 | 12/1949 | Zearfoss | 62/505 |
| 3,217,193 | 11/1965 | Rayner | 310/54 |
| 3,248,044 | 4/1966 | Parker | 417/902 |
| 3,279,683 | 10/1966 | Kleinlein | 417/363 |
| 3,497,135 | 2/1970 | Gannaway | 417/902 |
| 4,313,715 | 2/1982 | Richardson | 417/312 |

*Primary Examiner*—Richard E. Gluck

*Assistant Examiner*—Peter M. Cuomo

*Attorney, Agent, or Firm*—E. C. Arenz

[57] ABSTRACT

A hermetic refrigerant compressor having an electric motor and compressor assembly in a hermetic shell is cooled by oil which is first cooled in an external cooler 18 and is then delivered through the shell to the top of the motor rotor 24 where most of it is flung radially outwardly within the confined space provided by the cap 50 which channels the flow of most of the oil around the top of the stator 26 and then out to a multiplicity of holes 52 to flow down to the sump and provide further cooling of the motor and compressor. Part of the oil descends internally of the motor to the annular chamber 58 to provide oil cooling of the lower part of the motor, with this oil exiting through vent hole 62 also to the sump. Suction gas with entrained oil and liquid refrigerant therein is delivered to an oil separator 68 from which the suction gas passes by a confined path in pipe 66 to the suction plenum 64 and the separated oil drops from the separator to the sump. By providing the oil cooling of the parts, the suction gas is not used for cooling purposes and accordingly increase in superheat is substantially avoided in the passage of the suction gas through the shell to the suction plenum 64.

3 Claims, 3 Drawing Figures

OIL COOLED, HERMETIC REFRIGERANT COMPRESSOR

GOVERNMENT CONTRACT

The Government has rights in this invention pursuant to Prime Contract No. W-7405-ENG-26 and Subcontract No. 86X-24712-C awarded by the United States Department of Energy.

BACKGROUND OF THE INVENTION

This invention pertains generally to the art of hermetic refrigerant compressors, and in particular to a compressor structural arrangement to take advantage of oil cooling of the motor and compressor in a hermetic shell.

For the most part compressors used in refrigeration, air conditioning and heat pump applications have traditionally been cooled by means of the cool refrigerant suction gas being passed through the motor before it enters the cylinder. In any of the applications, this causes a temperature rise and superheating of the suction gas before it enters the cylinder inlet and, accordingly, there is a loss of capacity for a given displacement compressor as well as a loss in system efficiency. These losses are especially pronounced when the compressor is being used in the heating mode of a heat pump application with low outdoor temperatures since the returning suction gas is also of a relatively low temperature and then passes in heat transfer relation with the parts of the hot motor and compressor.

While not common in the art, it has been taught to use an oil cooler, external to the compressor, to provide cooled oil which is returned to the compressor for cooling and lubricating purposes. U.S. Pat. No. 2,225,228 provides an example of such an arrangement.

It is the aim of this invention to provide an arrangement of that general type, but in which certain advantageous structural features are employed.

SUMMARY OF THE INVENTION

In accordance with the invention, a hermetic refrigerant compressor of the vertical crankshaft type has a motor-compressor assembly therein with the motor above the compressor crankcase, and means at the top of the motor provide a confined space into which oil taken from the sump of the shell and externally cooled is delivered and discharged against the top of the rotor in the space. Means are provided for channeling a portion of the oil delivered to the confined space along the exterior of the stator of the motor, and the remainder of the oil delivered to the confined space is passed down through the rotor to cool it to an annular space at the bottom of the motor from which the remainder of the oil flows outwardly down along the exterior of the crank case. The suction gas returned to the shell is delivered to means for separating at least a part of the entrained oil from the suction gas and conveying the suction gas in a confined path to a suction plenum so that any rise in superheat is limited during the passage of the gas to the cylinders of the compressor.

DESCRIPTION OF THE PREFERRED EMBODIMENT

Figure 1:
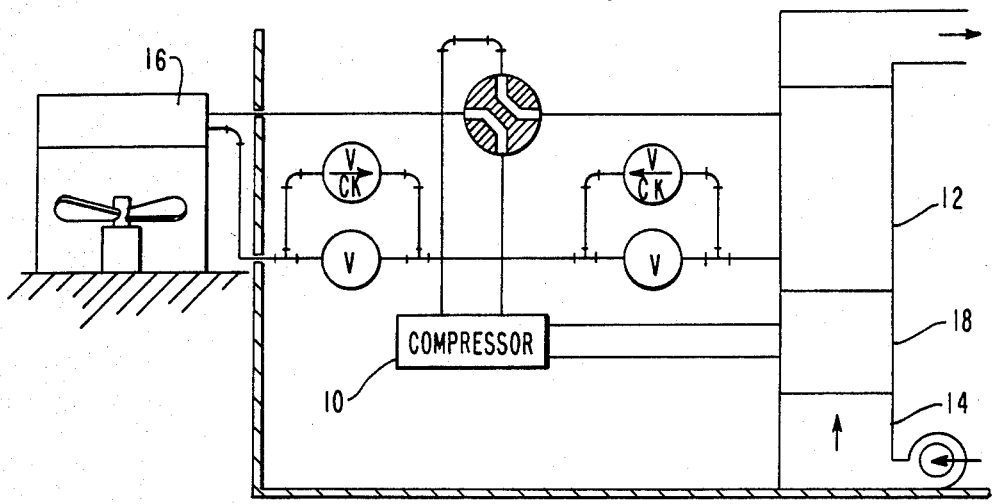
FIG. 1 is a schematic view illustrating the arrangement of the main parts of the system in a heat pump installation.

In FIG. 1 the arrangement, shown as an example in a heat pump installation, includes the compressor 10 located in the structure to be conditioned and with refrigeration lines and control elements in a conventional arrangement connecting the compressor to an indoor coil 12 in an air handler 14, and an outdoor coil 16. In this arrangement the cooler 18 is located on the air inlet side of the indoor coil 12 to maximize the amount of heat rejection from the coil. It will be appreciated that heat rejection from the compressor and oil cooler to the indoor space results in greater system efficiency improvement in a heating mode rather than in the cooling mode. As noted, the FIG. 1 arrangement is simply one example; and, if the system were to be used for air conditioning only, it would obviously provide both capacity and efficiency benefits to have the compressor and oil cooler both external to the structure.

Figure 2:
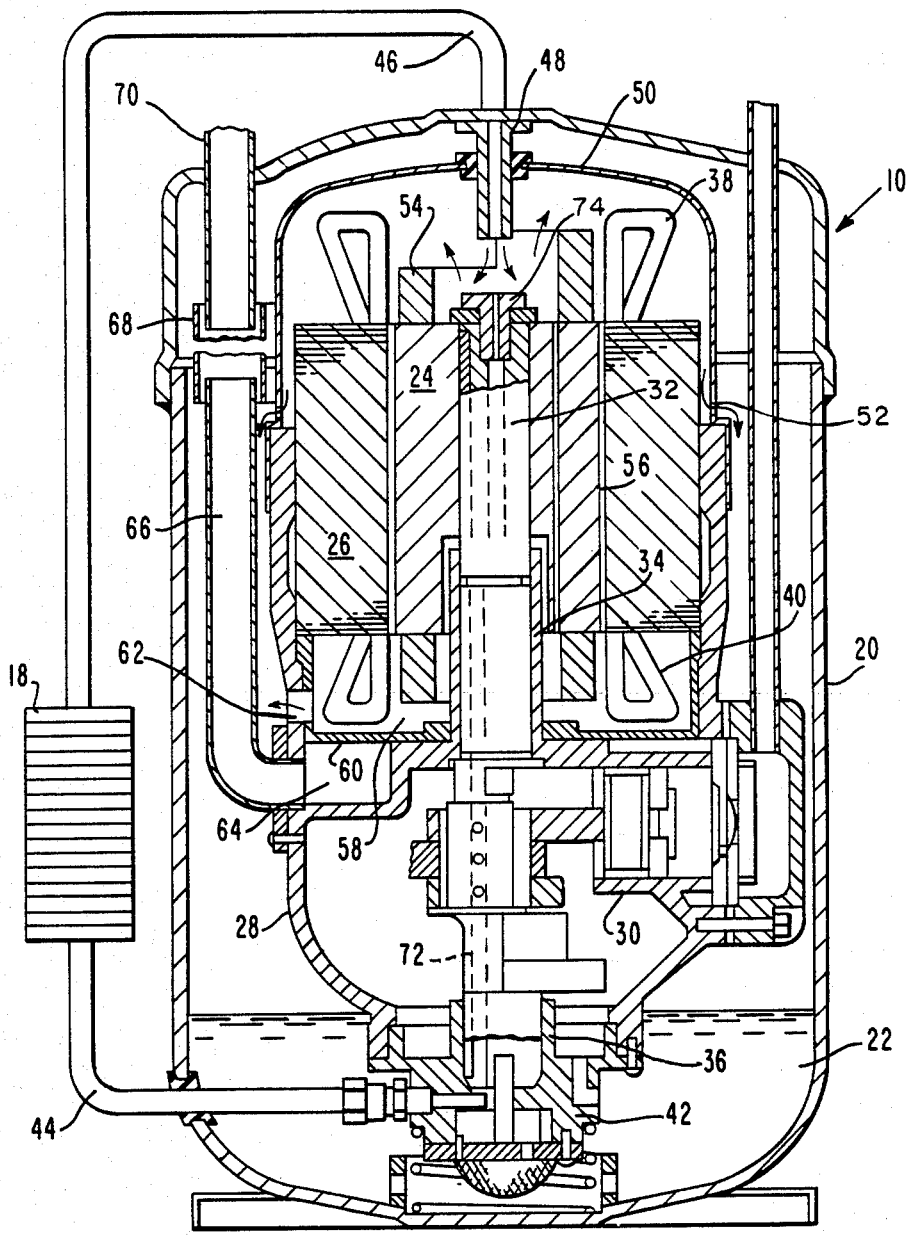
FIG. 2 is a vertical cross-sectional view of a compressor arrangement according to the invention.

Turning now to FIG. 2, the compressor 10 has a hermetic shell 20 with an oil sump 22 in its bottom portion, and contains an electric motor comprising an inner rotor 24 and an outer stator 26. The compressor crankcase 28 is in the lower portion of the shell and can have one or more cylinders 30. The compressor in FIG. 2 has three cylinders, only one of which is shown. The vertical crankshaft 32 is coupled to the rotor and is journaled in an upper bearing 34 and a lower bearing 36. The stator has upper end turns 38 and lower end turns 40.

The lower end of the crank case is immersed in the sump and an oil pump 42 driven by the crank shaft 32 pumps oil from the sump through the line 44, the external oil cooler 18, and line 46 which connects through the top of the shell 20 to the stub tube 48 which delivers the oil to the top of the rotor 24 as indicated by the arrows. A confined space is provided at the top of the motor by the cap or cover 50 which, in the particular embodiment shown extends down along the side of the upper portion of the exterior of the stator 26 to a circumferential connection with the upper rim of the crank case 28. A large number of holes 52, such as forty-eight in one embodiment, are spaced around the lower periphery of the cap.

The oil which is discharged from the stub tube 48 to the top of the motor rotor is for the most part splashed and spun radially outwardly by the rotation of the rotor 24 and passes over the end rings 54 and is spun against the upper stator end turns 38. Some of this oil passes through and over the end turns to the outer periphery of the cap 50 and down to the holes 52, while some of the oil flows downwardly through the stator slots and the gap between the rotor and stator. The remainder of the oil delivered to the confined space flows downwardly through the rotor passages 56 to the lower end of the motor and into an annular chamber 58 which has a floor provided by the partition means 60.

The oil which has reached the outer periphery of the cap 50 and exits through the multiplicity of holes 52 flows down along the remaining portion of the exterior of the stator and down along the crankcase exterior walls to the oil sump 22. The remainder of the oil which reaches the annular chamber 58 through the rotor passages 56, the air gap and the stator turns, builds up in the annular chamber and is flung to some extent radially outwardly against the lower end turns 40. This annular chamber is vented in a few places 62 around the circumference of the chamber, such as at three places, to permit the build-up of oil to exit therefrom and also flow down along the lower portion of the crankcase and into the sump 22.

The suction gas plenum 64 through which suction gas is fed to all of the suction ports of the cylinders is separated from the annular chamber 58 by the partition means 60. This suction plenum 64 is connected by a suction pipe 66 to the bottom of an oil separator 68 which receives suction gas with oil and liquid refrigerant entrained therein through the suction line 70 which passes through the shell 20. In FIG. 2, the suction line 70 is shown in a position in which it is revolved about 90 degrees from its actual position.

Figure 3:
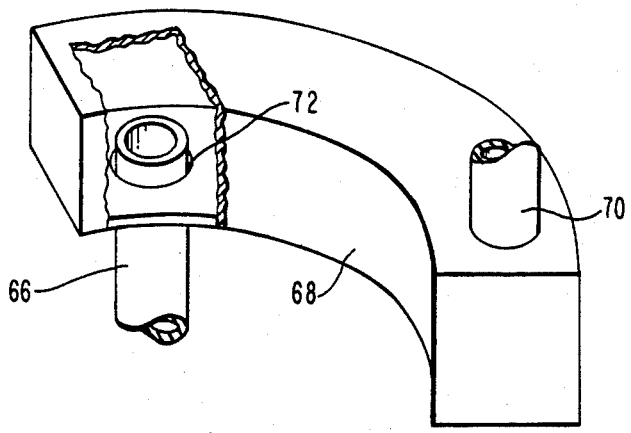
FIG. 3 is a partly broken isometric view of the oil separator arrangement for the suction gas.

The relation of the suction line 70, suction pipe 66 and the intervening separator 68 may best be seen in FIG. 3 which shows that the separator has the general form of a curved box-like shape with the suction line 70 connected near one end of the box, and the suction pipe 66 projecting up through the bottom wall of the box in a loose fit relation. This box 68 functions as an oil separator to remove at least some of the entrained oil and liquid refrigerant from the suction gas, this entrained oil and liquid refrigerant then passing out of the box and down to the sump through the annular gap 72 where the suction pipe 66 projects up into the box. If desired, the box 68 may be made of a thermal insulating material to minimize superheating of the gas as it passes through the separator to the suction pipe 66.

The oil pump 42 has a split discharge so that while most of the oil is pumped through line 44, another part of the oil is directed up into internal passages 72 in the vertical crankshaft to provide lubrication to the various parts requiring it. Such internal passages are of course conventional in this type of compressor and normally also deliver oil to the top of the rotor. In this case, the upper end of the internal passage in the crank shaft 32 is essentially capped with a plug 74 with a substantially reduced diameter bore to limit the oil delivered to the vertical passages 72.

It will be apparent from the description that the structure accomplishes the desired objective of providing oil cooling for the motor and compressor crankcase while maintaining the returning suction gas in a confined path out of communication with most of the hot metal parts of the compressor so as to avoid any significant increase in superheat of the suction gas.

What is claimed is:

1. An oil cooled, hermetic refrigerant compressor of the vertical crankshaft type, comprising:

a hermetic shell with an oil sump in the bottom thereof;

a motor-compressor assembly therein including an upper electric motor having an inner rotor and an outer stator having end turns, and a lower compressor crankcase having its lower end immersed in said pump;

means providing a confined space at the top of said motor;

means for pumping oil from said sump to oil cooling means external of said shell and returning the cooled oil to said confined space for discharge against the top of said rotor;

means for channeling at least the major portion of said oil delivered to said confined space along the exterior of said stator;

passage means in said rotor for flowing oil delivered to said confined space down through said rotor to cool said rotor;

an annular space at the bottom of said motor to receive said remainder of oil, said annular space having outlet means at its periphery to flow oil down along the exterior of said crankcase;

means for delivering suction gas with any oil entrained therein into said shell;

means for separating at least a part of said entrained oil from said suction gas and conveying said suction gas in a confined path to a suction plenum;

said confined space means comprises a cap encompassing the top of said motor; and said oil channeling means comprises a multiplicity of openings spaced around the lower periphery of said cap.

2. A compressor according to claim 1 wherein;

said oil pumping means comprises an oil pump immersed in said sump and driven by said crankshaft; and means for conveying a part of the oil delivered by said pump up through said crankshaft to bearings associated with said crankshaft.

3. An oil cooled, hermetic, refrigerant compressor of the vertical crankshaft type, comprising:

a hermetic shell with an oil sump in the bottom thereof;

a motor-compressor assembly therein including an upper electric motor including an inner rotor, and an outer stator having upper and lower end turns, and a lower compressor crankcase having its lower end immersed in said sump;

means for pumping oil from said sump to oil cooling means external of said shell and returning the cooled oil back into the top of said shell for discharge against the top of said rotor;

a cap encompassing the top of said motor to confine oil flung from said rotor to the space in said cap, said cap including means for channeling at least the major part of oil delivered to said cap along the exterior of said stator;

oil cooling passages in said rotor for conveying part of the oil discharged against said rotor to an annular space at the bottom of said motor;

partition means separating said annular space from an underlying suction gas plenum;

opening means in the periphery of said annular space for the egress of oil from said space down along the exterior of said crankcase;

means for delivering suction gas with any oil and liquid refrigerant entrained therein into said shell; and means for separating at least a part of said entrained oil and liquid refrigerant from said suction gas and conveying said suction gas in a confined path to said suction plenum underlying said annular space and out of communication therewith.

* * * * *